United States Patent [19]

Stocco et al.

[11] Patent Number: 4,999,020

[45] Date of Patent: Mar. 12, 1991

[54] VARIABLE DISPLACEMENT HIGH PRESSURE PUMP WITH INTERNAL POWER LIMITING ARRANGEMENT

[75] Inventors: Joseph A. Stocco, Liverpool; Howard J. Bradt, Whitesboro, both of N.Y.

[73] Assignee: Lucas Aerospace Power Transmission Corp., Utica, N.Y.

[21] Appl. No.: 443,662

[22] Filed: Nov. 30, 1989

[51] Int. Cl.[5] ..... F04B 1/26; F01B 13/4

[52] U.S. Cl. ..... 417/222; 91/506; 92/12.2

[58] Field of Search ..... 417/222; 91/506; 92/12.2

[56] References Cited

U.S. PATENT DOCUMENTS

| | | | |
|---|---|---|---|
| 3,139,006 | 6/1964 | Budzich | 91/506 |
| 3,256,830 | 3/1964 | Budzich | 91/506 |
| 3,736,073 | 5/1973 | Walmsley | 417/222 |
| 4,149,830 | 4/1979 | Woodruff | 417/222 |
| 4,355,510 | 10/1982 | Ruseff | 417/222 |
| 4,793,774 | 12/1988 | Bradt | 417/203 |

*Primary Examiner*—Leonard E. Smith
*Assistant Examiner*—Peter Korytnyk
*Attorney, Agent, or Firm*—Anthony F. Cuoco

[57] ABSTRACT

A variable displacement piston pump includes a plurality of axially aligned pumping cylinders with a drive shaft extending therebetween having a pivotable swash plate disposed in a relatively dry cavity at one end of the drive shaft for operating the pumping cylinders, and a reaction thrust plate on the other end of the drive shaft for providing a reaction force on the drive shaft opposite that provided by the swash plate. An inlet shaft seal prevents fluid, which enters the pump at the inlet port, from filling the mounting housing and submerging the mount shaft portion of a rotating assembly supporting the swash plate. Two needle roller bearings support the swash plate and transmit torque from the drive coupling to the swash plate. A high pressure fluid restrictor meters hydraulic control fluid to the two needle bearings. Pump power is limited by a pressure compensator arrangement which receives direct feedback of swash plate pivoted position, whereby a minimum pressure at a predetermined pump flow is established.

8 Claims, 4 Drawing Sheets

VARIABLE DISPLACEMENT HIGH PRESSURE PUMP WITH INTERNAL POWER LIMITING ARRANGEMENT

BACKGROUND OF THE INVENTION

This invention relates to variable displacement piston pumps which maintain constant pressure with variable flow, and particularly, to pumps wherein the shaft assembly can rotate without dissipating energy by agitating hydraulic fluid. More particularly, this invention relates to pumps of the type described which include an internal power limiting arrangement.

DESCRIPTION OF THE PRIOR ART

A type of variable displacement piston pump known in the prior art includes a shaft having a driven end and an opposite end arranged for supporting a swash plate. The swash plate is caused to pivot or slide about a fixed axis displaced from and generally perpendicular to the center line of the driven shaft. The swash plate is disposed in a cavity filled with hydraulic fluid to be pumped. Cylinders having pistons disposed therein are arranged with associated check valves in a fixed pump block. During the delivery stroke of the pistons, pressure in the cylinders becomes high enough to open the check valves and deliver fluid to a common discharge manifold. When the manifold pressure approaches a predetermined set value, a force is created which is transmitted to the swash plate and pivots the swash plate about the fixed axis, away from a maximum flow position. The pistons are arranged with respect to the swash plate so that when the swash plate so pivots, the stroke of the pistons is decreased to reduce fluid flow and pressure. Equilibrium is thus established and reduced fluid flow at a predetermined substantially constant pressure is maintained. A prior art example of this type of pump is described in commonly assigned U.S. Pat. No. 4,149,830 which issued to Frank Woodruff on Apr. 17, 1979.

In the pump disclosed in U.S. Pat. No. 4,149,830, a plurality of piston assemblies are provided. The piston assemblies reciprocate in a cylinder block which is fixed to the pump casing. The swash plate, in addition to pivoting to achieve equilibrium is caused to rotate. The rotation of the swash plate forces the pistons to reciprocate, thus achieving the desired pumping action. The shaft and the attached swash plate form a rotating assembly.

In aircraft hydraulic systems, it is important to maintain high efficiencies in order to minimize weight and power requirements. In prior art pumps, the rotating assembly is typically submerged in hydraulic fluid, and agitates the fluid as the pump operates. This prior art construction reduces pump efficiency and therefore necessitates more input power.

In some prior art pumps an arcuate cutout in the pump's shaft assembly supports the swash plate. This forms a sliding interface associated with varying the displacement of the pump. The frictional resistance to the onset of this sliding action causes a delay in the desired pivoting motion of the swash plate. Unwanted discharge pressure fluctuation may thus be caused by the swash plate's resistance to pivoting. It is desirable in aircraft applications, for example, to provide a high pressure variable output pump which is light in weight and has a smooth output such as achieved by the invention described in commonly assigned U.S. Pat. No. 4,793,774 which issued to Howard J. Bradt, et al on Dec. 27, 1988.

The present invention is an improvement over that described in the aforenoted U.S. Pat. No. 4,793,774 in that an internal power limiting feature is incorporated which limits pump flow with varying pressure demands to prevent exceeding required power limits.

In this connection it will be understood that prior art pumps of the type described usually incorporate variable pressure and delivery controls, but have no control against exceeding system power requirements. For applications where peak pressure and flow demands do not exist concurrently, the improvement herein disclosed solves a problem that prior art pumps do not address.

SUMMARY OF THE INVENTION

This invention contemplates a pump of the type described, wherein a swash plate which pivots in response to a control fluid pressure is not disposed in the fluid. The control fluid which positions the swash plate is supplied through an intermediate transfer tube within a hollow drive shaft assembly to decrease control fluid volume and speed response. This control fluid is supplied, by the pressure compensating valve, at an intermediate pressure such as, for example, 27,580 KPa (4000 psi).

The drive shaft assembly includes two needle or roller bearings which both support and drive the pivotable swash plate. These bearings alleviate the friction associated with conventional sliding trunnions. Long bearing life is facilitated by hydraulic fluid which is supplied to the bearings through the drive shaft. A high pressure restrictor is incorporated in the pump shaft to meter a small amount of control fluid to these bearings at low, ambient pressures.

A shaft seal disposed around the drive shaft within the center hole through a cylinder block, keeps the hydraulic fluid at the pump inlet from filling the cavity in which the pivotable swash plate is housed. Fluid which leaks into the swash plate cavity is removed through a drain port. The swash plate and its associated mounting shaft can thus rotate without being submerged in hydraulic fluid. This construction reduces energy loss otherwise caused by the agitation of fluid by the rotating swash plate assembly, as will be appreciated.

Power limiting is accomplished through a pressure compensator arrangement which is positioned so that it can receive direct feedback of swash plate position (pump displacement). In the preferred embodiment of the invention the compensator is included in the rotating assembly since the swash plate rotates. However, it will be understood that the arrangement is equally applicable to pumps with non-rotating swash plates.

DETAILED DESCRIPTION OF THE INVENTION

Figure 1:
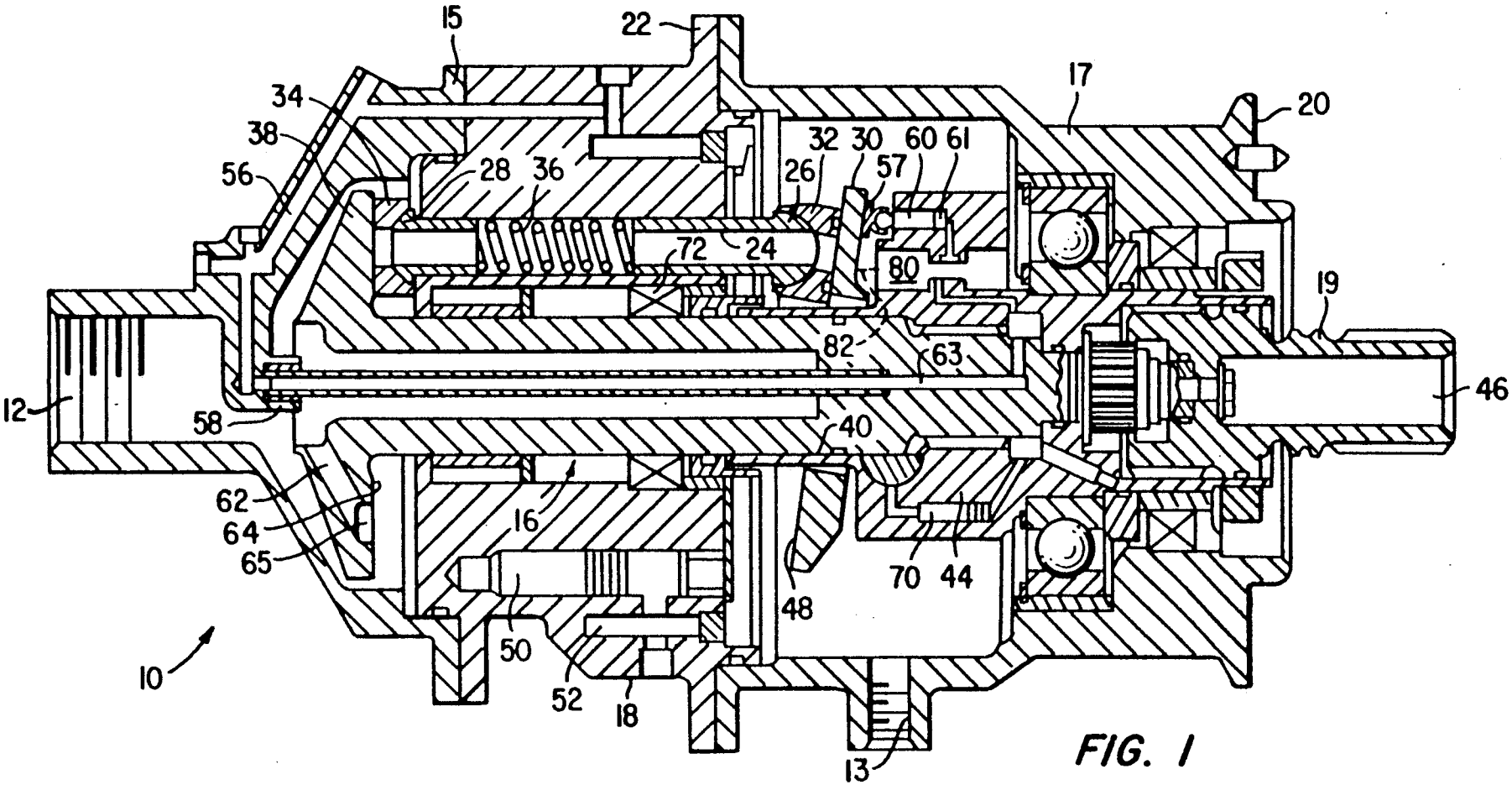
FIG. 1 is a sectional view taken along lines 1—1 of FIG. 2 showing a pump according to the invention.

Referring now to the drawings, and particularly to FIG. 1, there is shown a variable displacement high pressure piston pump 10 constructed according to the present invention. Pump 10 is capable of working at high pressures, such as, for example, 55,160 KPa (8000 psi) and above, and is relatively lightweight and suitable for aircraft hydraulic systems.

Figure 2:
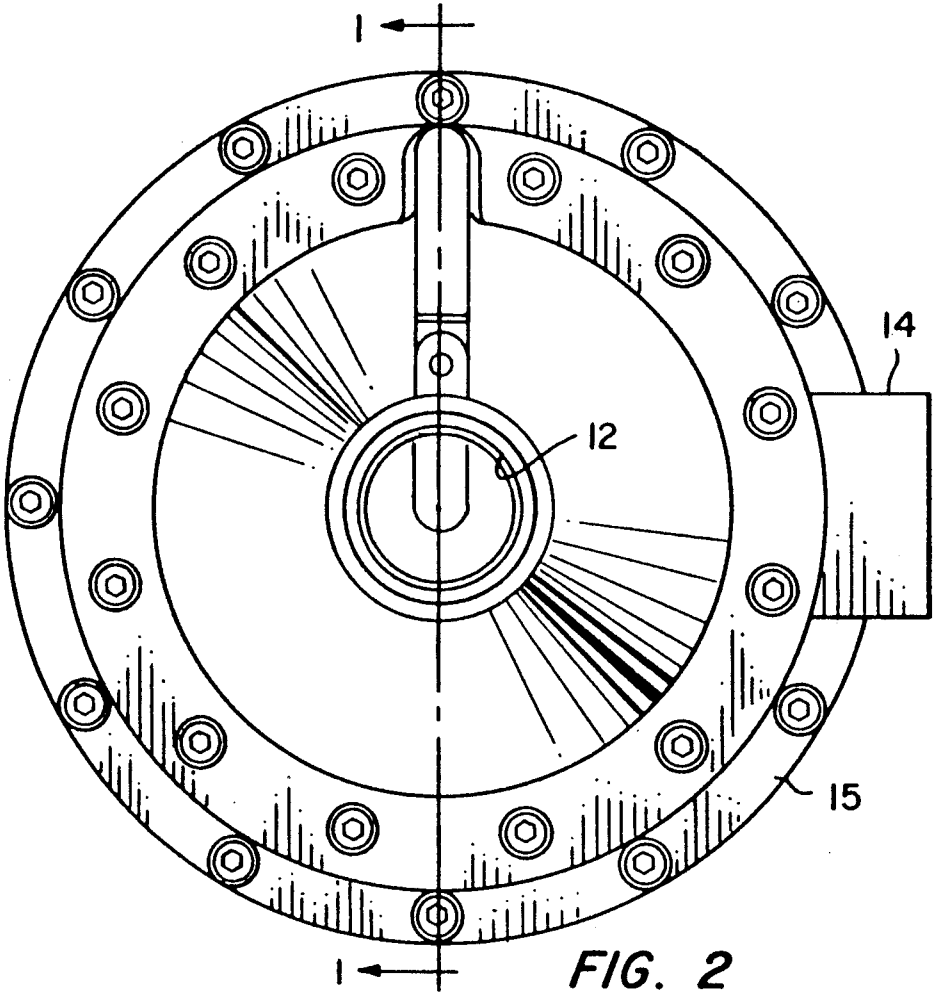
FIG. 2 is an inlet end view of the pump.

Hydraulic fluid is fed at low pressure to pump 10 through an inlet port 12 and is discharged at the desired pressure from an outlet port 14 (FIG. 2). Pump 10 includes a rotating assembly 16 which rotates within a housing 18. Housing 18 includes a mounting flange 20 by which pump 10 is mounted to a suitable power source such as a gear casing of a gas turbine engine (not shown). Rotating assembly 16 includes a splined input shaft having spline teeth 19 or other suitable means for engaging a power take off output of a power source (not shown).

A fixed cylinder block 22 having a plurality of cylinder bores 24 formed therein is disposed between end members 15 and 17 to form part of housing 18. While cylinder block 22 includes a plurality of cylinder bores 24 only one is shown in FIG. 1 and the operation of only one will be described.

Cylinder block 22 is fixed between members 15, 17 and its outer surface is exposed as part of housing 18. Each cylinder 24 in bore block 22 houses an active pumping piston 26 and a dummy piston 28. Active pistons 26 are displaced via rotation of an inclined swash plate 30. An extending outer end of active piston 26 engages a shoe 32 and an extending outer end of dummy piston 28 engages a shoe 34. A spring 36 is disposed in cylinder 24 to bias pistons 26 and 28.

Shoe 32 at the outer end of active piston 26 engages swash plate 30 while shoe 34 at the outer end of dummy piston 28 engages a thrust plate centrifugal impeller 38. Rotating assembly 16 includes a center shaft 40 extending to form thrust plate 38 integral therewith. The axial forces, generated during pumping, on swash plate 30 also act on shaft 40 and which axial forces are contained within rotating assembly 16 and are not transmitted to housing 19 as will now be understood.

As will now be discussed, active piston 26 moves with respect to cylinder 24 as swash plate 30 rotates to effect pumping action. Dummy piston 28 remains substantially in the same position with respect to cylinder 24 while pumping, although it is free to float in order to adjust for discrepancies in the relative distances between parts of rotating assembly 16 and in order to transfer axial forces from the pumping action of active piston 26 outside of cylinder 24 to thrust plate 38.

Figure 3:
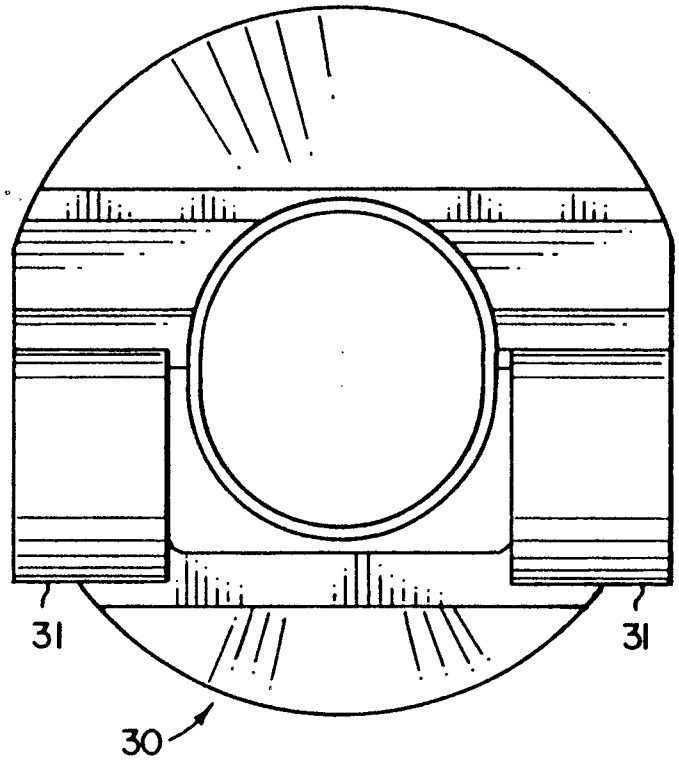
FIG. 3 is a top view of a swash plate included in the pump.
Figure 4:
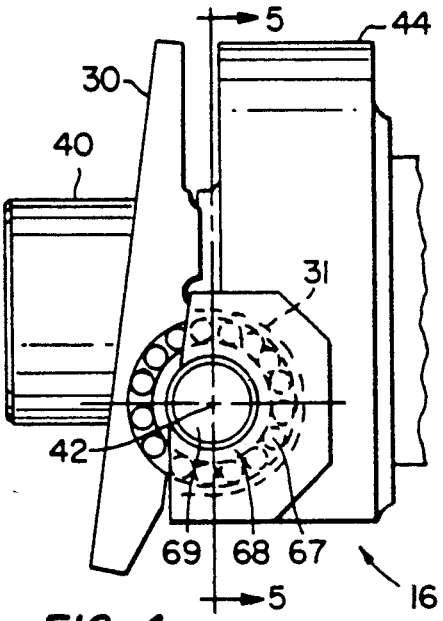
FIG. 4 is a detailed view of a portion of a drive assembly including the swash plate and supporting bearings.
Figure 5:
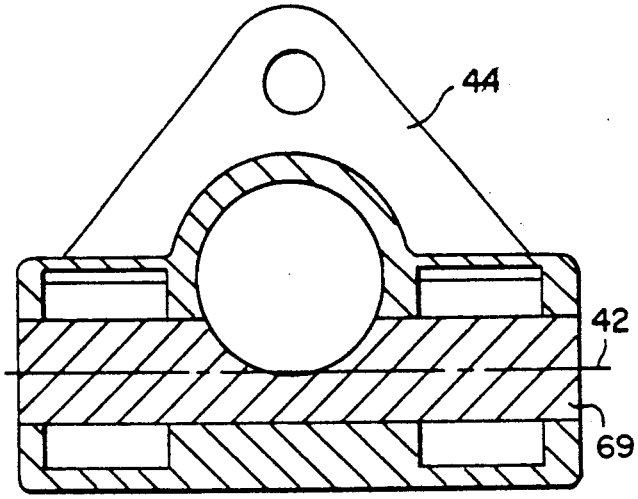
FIG. 5 is a sectional view taken along lines 5—5 in FIG. 4, with the swash plate and bearings deleted for clarity.

Swash plate 30 has a center opening therethrough and is mounted around center shaft 40. Swash plate 30 is pivotally mounted to rotating shaft assembly 16. Circular projections 31 (FIGS. 3 and 4) on swash plate 30 house needle bearings 67 as particularly shown in FIG. 4. Inner rings 68 of bearings 67 are supported by a trunnion pin 69 which fits tightly into a mount shaft 44. The operation of swash plate 30 is conventional and is described in detail in the aforenoted U.S. Pat. No. 4,149,830. Briefly, swash plate 30 pivots relative to mount shaft 44 around axis 42. Rotating assembly 16 employs needle bearings 67 which both support and drive swash plate 30. Easy movement of swash plate 30 is made possible by utilizing a high pressure fluid restrictor 70 (FIG. 1) to meter hydraulic fluid from a control passage 63 into each needle bearing 67. Swash plate 30 is pinned to mount shaft 44 by trunnion pin 69 through needle bearing 67.

Swash plate 30 pivots about axis 42 on needle bearings 67 which rotate on trunnion pin 69. Trunnion pin 69 is rigidly pressed into mount shaft 44. The pivoting of swash plate 30 on needle bearings 67 is in response to discharge pressure. As shown in FIG. 1, pressurized fluid for controlling the inclination of swash plate 30 is provided through a passage 56 and a rotating tube seal 58 through a passage 63, then by a pressure compensating valve 80 to a chamber 61 behind a piston 60. This pressurized control fluid from pressure compensating valve 80 is provided at an intermediate pressure such as, for example, 27,580 KPa (4000 psi). Piston 60 has a swivellable shoe 57 which contacts and pivots swash plate 30 about axis 42.

The aforementioned rotating tube seal 58 replaces the balanced piston seal used in some prior art pumps. A shaft seal 72 housed in the center hole through piston block 22 and encircling shaft 40 keeps fluid which enters at inlet port 12 from filling the cavity in housing 17 where rotating shaft 44 and swash plate 30 are located. Any fluid which leaks into the cavity is drained from pump 10 through an external port 13 in pump housing 18. The fluid drained from pump 10 is returned to the system at or above inlet pressure by means of a scavenge pump (not shown).

Thus, shoe 32 on active piston 26 engages swash plate 30 while shoe 34 at the free end of dummy piston 28 engages thrust plate centrifugal impeller 38. Rotatable drive assembly 16 including center shaft 40 extends to form integral thrust plate 38. The axial forces, generated during pumping, on swash plate 30 also react on shaft 40 and are contained within the rotating drive assembly 16, not being transmitted to housing 18.

As will now be discerned, active piston 26 moves with respect to cylinder 24 as swash plate 30 rotates to effect pumping action. Dummy piston 28 remains substantially in the same position with respect to cylinder 24 while pumping, although it is free to float in order to adjust for discrepancies in the relative distances between parts of rotating assembly 16 and in order to transfer axial forces from the pumping action of active piston 26 outside of cylinder 24 to thrust plate 38.

Swash plate 30 pivots on needle bearings 67 in response to outlet pressure. Swash plate 30 may be positioned at varying angles to the center axis of pump 10. Swash plate 30 is rotationally fixed to center shaft 40 and therefore, whenever its working face 48 is displaced form the perpendicular with respect to axis 46, active pistons 26 are reciprocated as assembly 16 rotates. In order to reduce pumping action, swash plate 30 is pivoted to bring working surface 48 towards perpendicular alignment with axis 46. To increase pumping action, swash plate 30 pivots at a greater angle with respect to perpendicular alignment with axis 46. Pivoting of swash plate 30 is accomplished through pressurized fluid, at the outlet pressure, within passage 63.

Shoes 32 are hydraulically balanced at both the piston 26 and swash plate 30 interfaces. Likewise, shoes 34 are hydraulically balanced at both piston 28 and thrust impeller plate 38. Shoes 32, 34 are similar to the shoes described in aforenoted U.S. Pat. No. 4,149,830. Pressure balancing of shoes 34, 32 is accomplished by a through hole and a vented annulus (not shown) cut in the end of the shoe away from the respective pistons 26, 28. The through hole pressure plus pressure distribution across the ends balance any forces developed by the pistons. The vented annulus helps to provide a constant fluid film and prevents overpressurization.

Each cylinder pump has associated therewith a check valve assembly 50, one of which assemblies is shown in FIG. 1. Minimizing discharge pulsations in a high pressure pump unit is an important criteria towards accurate system performance. An effective way of achieving a smooth pulse trace is through the use of individual check valves 50 with each pumping cylinder 24. During discharge, fluid from each check valve piston assembly will be expelled just after system pressure plus valve spring force return is achieved. There is no possibility of exposing the system to a lesser discharge than desired and therefore the possibility of increased pulsation is reduced. The discharge from pumping cylinders 24 during operation is through the associated check valves 50 into a common manifold 52.

To maintain a constant discharge pressure, pressure compensating valve 80, which communicates with manifold 52 is utilized. Pressure compensating valve 80 modulates discharge pressure. As aforenoted, pressurized fluid for controlling the inclination of swash plate 30 is provided through passage 56 and seal 58 through passage 63 to pressure compensating valve 80, which then establishes an intermediate control pressure in chamber 61 behind piston 60. When fluid flow from pump 10 is greater than conditions require, discharge pressure increases. The resulting intermediate pressure behind tilt piston 60 is increased. This pressure increase will move piston 60 to the left in FIG. 1, lessening the swash plate angle and thereby decreasing flow. The converse of the above description applies when conditions require an increase in flow.

Piston 60 includes swivellable shoe 57 which engages and tilts swash plate 30 around axis 42. When piston 60 is forced to the left in FIG. 1, swash plate 30 is moved towards vertical alignment and thereby decreases the stroke of working piston 26. The inlet to pump housing 18 is through port 12. A passage 62 is formed in thrust plate 38 which extends from the center shaft 40. Thrust plate 38 during operation acts as a centrifugal pump, boosting the pressure of the hydraulic fluid supplied through port 12. Thrust plate 38 includes a working surface 64 on which shoes 34 ride as plate 38 rotates. Passage 62 connects to an opening 65 in the working face 64 of thrust plate 38.

As thrust plate 38 rotates, when an opening 65 in the working surface 64 aligns with the opening in shoe 34, fluid passes through dummy piston 28 into cylinder 24. Force balancing of working piston 26 thrust load is accomplished by dummy piston 28, which is placed opposite working piston 26. Dummy piston 28 rides through shoe 34 on thrust plate 38 and transmits negative forces required to balance the positive forces of working piston 26. The working surface 34 of thrust plate 38 is used as the dummy piston 28 bearing surface. The dummy pistons 28 are used to create an equal force opposite to the force developed by the working pistons 26. This approach saves weight and decreases the envelope size. The larger bearings as required in prior art high pressure similar type piston pumps are therefore not required.

The disclosed high pressure variable displacement piston pump will boost an inlet pressure of 103 KPa (15 psi) to 55,160 KPa (8000 psi) or greater and hold it there under a variety of flow and speed conditions. By providing centrifugal pump impeller plate 38 integral with the drive shaft 40, the inlet fluid pressure can be raised as a function of rotational speed by an amount such as 138 KPa (20 psi). This avoids cavitation in the pump. Rotating swash plate 30 provides the reciprocating action for working piston 26. Once system pressure has been developed by a piston, its associated check valve 50 will open thereby releasing fluid to the pump manifold 52 and discharge port 16.

In a pump having several working pistons, the pulse magnitude is a small percentage of the discharge pressure. Return springs 36, which assist in the suction stroke, in the piston pump assembly are required primarily for cold start up. Once system pressure has been established, the spring force when pumping becomes insignificant. Pressure compensating valve 80 through piston 60 and the pivoting of swash plate 30 controls the output pressure. Pressure compensating valve 80 operates until an equilibrium has been achieved and pressure will hold constant. Following changes in the load, pressure compensating valve 80 causes corresponding corrections of the swash plate 30 angle. The pressure in cavity 61 behind piston 60 is that pressure required to balance the moment which is transmitted to the swash plate by the pump piston. This is an intermediate pressure such as 27,580 KPa(4000 psi).

The variable displacement high pressure pump so far described is substantially the same as that described in the aforenoted U.S. Pat. No. 4,793,774. In the invention herein disclosed, however, power limiting is achieved through the location and orientation of pressure compensating valve 80. Pressure compensating valve 80, shown generally in FIG. 1, is shown in substantial detail in FIG. 6.

Figure 6:
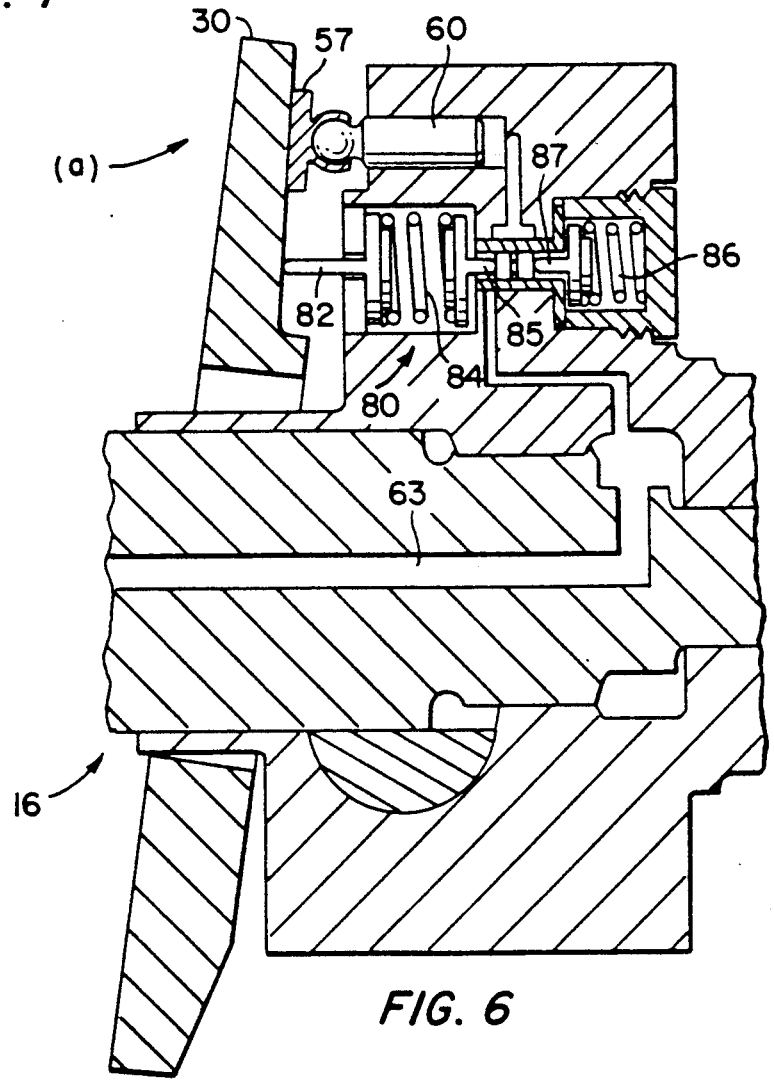
FIG. 6 is a partial sectional view particularly showing the power limiting arrangement of the invention.
Figure 7:
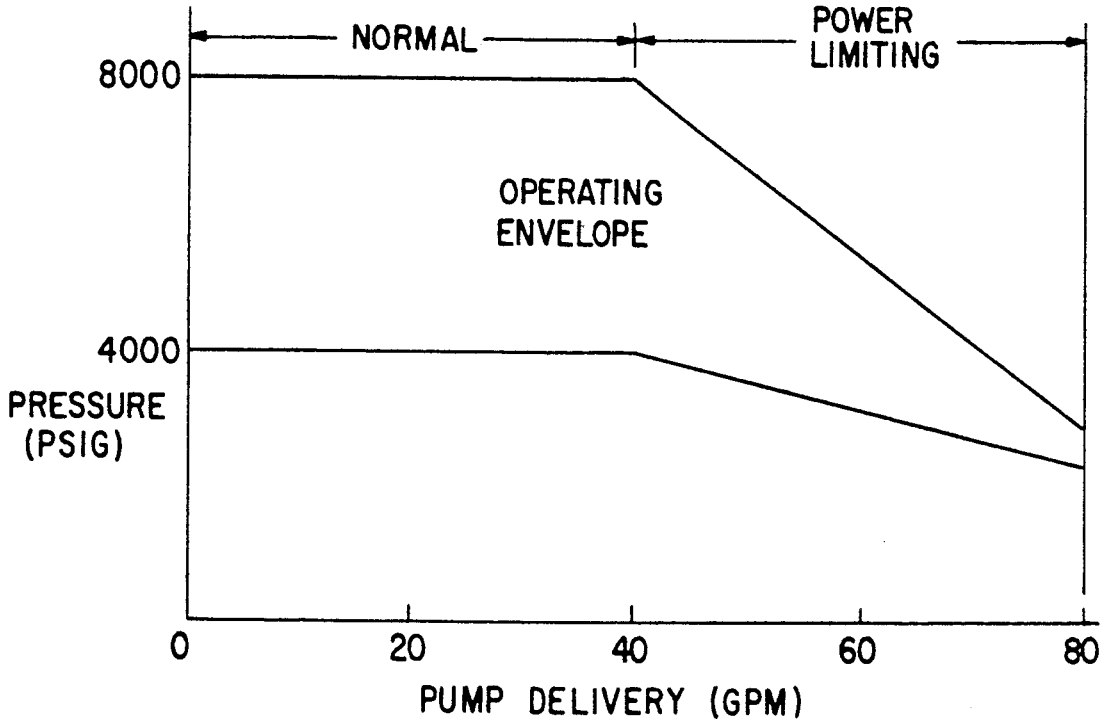
FIG. 7 is a graphical representation illustrating the performance envelope of a pump including the aforenoted power limiting arrangement.

Thus, pressure compensating valve 80 is positioned in rotating assembly 16 so as to receive direct feedback of the position of swash plate 30 (pump displacement). With particular reference to FIG. 6, whenever swash plate 30 pivots in the direction of arrow (a) and reaches a predetermined position it engages a feedback plunger 82 which biases a spring 84. Spring 84 increasingly offsets a pressure compensator spring 86 via a plunger 85 which engages a plunger 87. In this way the setting of pressure compensating valve 80 is constant until a predetermined flow of, for example, 40 GPM is reached. The setting then decreases continuously to an established minimum pressure at a flow of, for example, 80 GPM. The resulting performance envelope of the disclosed pump is graphically shown in FIG. 7. The power-limited region of the graph in the Figure (40–80 GPM) is established to provide, for example, a minimum flow of 80 GPM at 4000 psi in a power limiting mode. In other words, for an 8000 psi setting, pressure is limited to 4000 psi at 80 GPM flow. The aforenoted values are commensurate with the sizing of compensator feedback spring 84 and can, of curse, be altered to suit particular design requirements.

The disclosed power limiting feature facilitates weight reduction in both the pump and the system incorporating same by providing a unique balance of high pressure and high flow in a compact package. By limiting the maximum power level within the pump, the peak loads associated with supplying maximum flow at maximum pressure are eliminated. In doing so the structural requirements of the pump are reduced. As with a standard pressure compensated pump, the proposed pump varies delivery in order to convert only enough power to meet system needs. This contributes to high efficiency and low heat rejection. Variable pressure controls further reduce heat rejection by reducing wear and friction problems when system demand is low. Both of the above features are enhanced by limiting input power to maximum system demand levels.

With the aforenoted description of the invention in mind, reference is made to the claims appended hereto for a definition of the scope of the invention.

What is claimed is:

1. A variable displacement multiple piston pump having an inlet and an outlet disposed in a housing which includes a cylinder block with a plurality of cylinders each having a pumping piston which is caused to reciprocate by a swash plate disposed in a cavity and pivotable in response to outlet pressure to vary the stroke of the pumping piston to maintain the output pressure relatively constant, the improvement comprising:

pressure compensating means disposed in the cavity in engagement with the swash plate for receiving direct feedback of the pivoted position thereof; and the pressure compensating means being responsive to a predetermined pivoted position of the swash plate for being at a constant setting until a predetermined pump flow is achieved, whereupon the setting decreases to establish a minimum pressure at a predetermined flow for limiting pump power requirements.

2. A pump as described by claim 1, wherein the pressure compensating means includes:

a first feedback plunger in engagement with the swash plate;

a first spring in engagement with the first feedback plunger and biased thereby in response to the pivoted position of the swash plate;

a second plunger in engagement with the first spring;

a third plunger in engagement with the second plunger; and a second pressure compensator spring in engagement with the third plunger and biased thereby through the first spring and the second and third plungers for being at the constant setting.

3. A pump, having a housing with an inlet and an outlet, comprising:

a plurality of cylinders disposed in said housing, each including a reciprocable piston means for pumping fluid in its associated cylinder;

an elongated drive shaft disposed in the housing;

swash plate means disposed in a cavity and connected to one end of said drive shaft for engaging and moving into each cylinder its associated, reciprocable piston means as said drive shaft rotates and for transferring positive pumping generated forces to said drive shaft;

a thrust plate disposed at the opposite end of said drive shaft;

means for transferring through the thrust plate to the drive shaft forces opposite those transferred to the drive shaft by the swash plate means;

mechanical seal means disposed around said elongated drive shaft for preventing fluid to be pumped from filling the cavity in which the swash plate rotates;

pressure compensating means disposed in the cavity in engagement with the swash plate for receiving direct feedback of the position thereof; and the pressure compensating means being responsive to a predetermined pivoted position of the swash plate for being at a constant setting until a predetermined pump flow is reached, whereupon the setting decreases to establish a minimum pressure at a predetermined flow for limiting pump power.

4. A pump as described by claim 3, wherein the pressure compensating means includes:

a first feedback plunger in engagement with the swash plate;

a first spring in engagement with the first feedback plunger and biased thereby in response to the pivoted position of the swash plate;

a second plunger in engagement with the first spring;

a third plunger in engagement with the second plunger; and a second pressure compensator spring in engagement with the third plunger and biased thereby through the first spring and the second and third plungers for being at the constant setting.

5. A variable displacement piston type pump comprising:

a housing having an inlet and an outlet;

a cylinder block disposed in said housing having a plurality of cylinders formed therein;

a plurality of active pistons, one disposed in each of the cylinders, biased to extend from the cylinder;

a swash plate disposed in a cavity and engaging a portion of each piston extending from its associated cylinder and being pivotable and rotatable to engage and move the piston varying distances as a function of swash plate pivoted position;

drive means including roller bearings for supporting and driving said swash plate from a shaft extending through said swash plate and said cylinder block;

a thrust plate disposed on the drive shaft opposite said swash plate;

means partially disposed in the cylinders of said cylinder block opposite the active pistons for transferring to said thrust plate an axial force opposite to the force transferred by said swash plate to said drive shaft during pumping operation;

pressure compensating means disposed in the cavity in engagement with the swash plate for receiving direct feedback of the pivoted position thereof; and the pressure compensating means being responsive to a predetermined pivoted position of the swash plate for being at a constant setting until a predetermined pump flow is achieved, whereupon the setting decreases to establish a minimum pressure at a predetermined flow for limiting pump power requirements.

6. A variable displacement piston type pump, in which a swash plate rotates relative to a plurality of pistons and is adjusted through a pivot angle in order to adjust the travel of the pistons and, consequently, the output of the pump, comprising:

a housing containing a fluid;

a shaft disposed in the housing, one end of the shaft arranged for being rotatably driven to operate the pump;

the swash plate pivotable supported within a cavity formed in said housing by said shaft for displacement about a pivot axis displaced from and transverse to the shaft axis;

at least one cylinder assembly having a cylinder bore extending therethrough and having at least one piston reciprocally mounted in the cylinder bore, the piston arranged with the swash plate so that the piston stroke varies with the swash plate pivot angle;

means arranged within the housing and the cylinder assembly so that fluid flows from the housing to the cylinder assembly during a pump intake stroke and is blocked from flowing during a pump delivery stroke;

a pump discharge manifold;

check valve means arranged between the manifold and the cylinder and actuated by a fluid pressure difference between the cylinder and the manifold during a delivery stroke of the piston for permitting passage of a fluid from the cylinder to the manifold, whereupon a pressure is created in the manifold;

means for controlling manifold pressure by displacing the swash plate and thereby varying the stroke of the piston;

means axially fixed to said shaft for providing a reaction force to the swash plate in response to the pumping action of the swash plate;

seal means for preventing fluid in said housing from filling the cavity within which said swash plate is supported;

pressure compensating means disposed in the cavity and including a first feedback plunger in engagement with the swash plate, a first spring in engagement with the first feedback plunger and biased thereby in response to the pivoted position of the swash plate, a second plunger in engagement with the first spring, a third plunger in engagement with the second plunger, and a second pressure compensator spring in engagement with the third plunger and biased thereby through the first spring and the second and third plungers in response to a predetermined pivoted position of the swash plate, whereby the pressure compensating means is at a constant setting until a predetermined pump flow is achieved, whereupon the setting decreases to establish a minimum pressure at a predetermined flow for limiting pump power requirements.

7. A variable displacement multiple piston pump having an inlet chamber with an inlet and an outlet disposed in a housing which includes a cylinder block with a plurality of cylinders each having a pumping piston which is caused to reciprocate by rotating a swash plate disposed in a pump cavity and pivotable in response to outlet pressure to vary the stroke of the pumping piston to maintain the output pressure relatively constant, the improvement comprising:

a drive shaft extending through the pump cavity and the cylinder block, and into the inlet chamber;

a thrust plate disposed in the inlet chamber and mounted on said drive shaft;

a mechanical seal which prevents fluid at the inlet from filling the cavity in which the tiltable swash plate rotates; and pressure compensating means disposed in the cavity and including a first feedback plunger in engagement with the swash plate, a first spring in engagement with the first feedback plunger and biased thereby in response to the pivoted position of the swash plate, a second plunger in engagement with the first spring, a third plunger in engagement with the second plunger, and a second pressure compensator spring in engagement with the third plunger and biased thereby through the first spring and the second and third plungers in response to a predetermined pivoted position of the swash plate, whereby the pressure compensating means is at a constant setting until a predetermined pump flow is achieved, whereupon the setting decreases to establish a minimum pressure at a predetermined flow for limiting pump power requirements.

8. A variable displacement piston type pump for pumping hydraulic fluid comprising:

a housing having an inlet chamber and an outlet;

a cylinder block disposed in said housing having a plurality of cylinders formed therein;

a plurality of active pistons, one disposed in each of the cylinders, biased to extend from the cylinder;

a swash plate disposed in a cavity and engaging a portion of each piston extending from its associated cylinder and being pivotable and rotatable to engage and move the piston varying distances as a function of swash plate pivot;

a thrust plate disposed in said inlet chamber opposite said swash plate with said cylinder block disposed therebetween;

a drive shaft having said thrust plate attached to one end and extending through said cylinder block to support said swash plate;

seal means disposed between the inlet chamber and the cavity in which said swash plate is disposed for preventing hydraulic fluid from filling the cavity; and pressure compensating means disposed in the cavity and including a first feedback plunger in engagement with the swash plate, a first spring in engagement with the first feedback plunger and biased thereby in response to the pivoted position of the swash plate, a second plunger in engagement with the first spring, a third plunger in engagement with the second plunger, and a second pressure compensator spring in engagement with the third plunger and biased thereby through the first spring and the second and third plungers in response to a predetermined pivoted position of the swash plate, whereby the pressure compensating means is at a constant setting until a predetermined pump flow is achieved, whereupon the setting decreases to establish a minimum pressure at a predetermined flow for limiting pump power requirements.

* * * * *